US007323812B2

(12) United States Patent
Tatsumi et al.

(10) Patent No.: US 7,323,812 B2
(45) Date of Patent: Jan. 29, 2008

(54) PROCESS FOR PRODUCING DIAMOND ELECTRON EMISSION ELEMENT AND ELECTRON EMISSION ELEMENT

(75) Inventors: Natsuo Tatsumi, Itami (JP); Akihiko Namba, Itami (JP); Yoshiki Nishibayashi, Itami (JP); Takahiro Imai, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 31 days.

(21) Appl. No.: 10/555,296

(22) PCT Filed: Sep. 29, 2004

(86) PCT No.: PCT/JP2004/014671

§ 371 (c)(1),
(2), (4) Date: Nov. 2, 2005

(87) PCT Pub. No.: WO2005/031781

PCT Pub. Date: Apr. 7, 2005

(65) Prior Publication Data

US 2006/0220514 A1 Oct. 5, 2006

(30) Foreign Application Priority Data

Sep. 30, 2003 (JP) ..... 2003-340594

(51) Int. Cl.
*H01J 9/30* (2006.01)

(52) U.S. Cl. ..... 313/309; 313/336; 313/351

(58) Field of Classification Search ..... 445/23–25, 445/49–51

See application file for complete search history.

(56) References Cited

U.S. PATENT DOCUMENTS 6,200,652 B1 * 3/2001 Sun et al. ..... 427/573

FOREIGN PATENT DOCUMENTS

| | | |
|---|---|---|
| JP | 7-57620 A | 3/1995 |
| JP | 8-264111 A | 10/1996 |
| JP | 9-320450 A | 12/1997 |
| JP | 10-312735 A | 11/1998 |

(Continued)

OTHER PUBLICATIONS

International Search Report for PCT/JP2004/014671 mailed Feb. 1, 2005.

(Continued)

*Primary Examiner*—Joseph Williams
(74) *Attorney, Agent, or Firm*—Darby & Darby P.C.

(57) ABSTRACT

A method for production includes a step for forming concave molds on a surface of a substrate and a step for growing a diamond heteroepitaxially on the substrate in an atmosphere containing a doping material. The crystal structure of the slope of the concave molds of the substrate can have the cubic system crystal orientation (111), and the doping material is phosphorous. Further, the substrate is Si, and the slope of the molds can be the Si(111) face. The diamond electron emission device contains projection parts on the surface thereof, where a slope of the projection parts 1 contains a diamond (111) face, and flat parts 2, which are not the projection parts, contain face orientations other than (100) face or (110) face and grain boundaries.

4 Claims, 4 Drawing Sheets

FOREIGN PATENT DOCUMENTS

| | | | |
|---|---|---|---|
| JP | 11-185964 | A | 7/1999 |
| JP | 2000-260299 | A | 9/2000 |
| JP | 2001-348296 | A | 12/2001 |
| JP | 2002-15658 | A | 1/2002 |
| JP | 2002-231628 | A | 8/2002 |
| WO | WO-93/15522 | A1 | 8/1993 |
| WO | WO-98/44529 | A1 | 10/1998 |

OTHER PUBLICATIONS

W. B. Choi, et al., Field Emission from Diamond Coated Molybdenum Field Emitters, J. Vac. Sci. Technol. B 14(3), May/Jun. 1996, American Vacuum Society, pp. 2050-2055.

PCT International Preliminary Report on Patentability for PCT/JP2004/014671 issued on Jun. 20, 2006.

* cited by examiner

PROCESS FOR PRODUCING DIAMOND ELECTRON EMISSION ELEMENT AND ELECTRON EMISSION ELEMENT

CROSS-REFERENCE TO PRIOR APPLICATION

This is a U.S. National Phase application under 35 U.S.C. §371 of International Patent Application No. PCT/JP2004/014671 filed on Sep. 29, 2004. The International Application was published in Japanese on Apr. 7, 2005 as WO 2005/031781 A1 under PCT Article 21(2).

TECHNICAL FIELD

The present invention relates to a method for producing an electron emission device which emits electron beams, especially a field emission cold cathode, and to an electron emission device, especially a field emission cold cathode.

BACKGROUND ART

Recently cold cathode devices are getting attention as an electron beam source. In the cold cathode a microprocessing technology is required to increase field intensity. As materials for the cold cathode, Si, to which microprocessing may be applied, and metals with high melting points such as W and Mo, which are heat resistant, have been used, but diamond cold cathodes are getting attention because it has negative electron-affinity.

Various forms have been proposed for the diamond cold cathode. For example, there are a pn junction type described in the publication WO93/15522, and a metal cathode coated with diamond described in Journal of Vacuum Science and Technology B14 (1996) 2050. In the pn junction type, as shown in FIG. 5, an n-type diamond 51 is layered on a p-type diamond 52, and an electrode 50 is disposed on the n-type diamond 51, wherein bias voltage is applied to the electrode to emit electron. Further, as shown in FIG. 6, sharpened diamond cathodes are proposed in Japanese Laid Open Patent Publication No. Hei 8-264111 and the publication WO98/44529, wherein a diamond 60 is formed in a Si mold 61.

DISCLOSURE OF INVENTION

To use diamond as an electron emission device, diamond must be doped with an impurity to become electrically conductive. In the p-type diamond as described in the publication WO98/44529, the doping effect of boron is so high that a relatively shallow impurity level is formed and the resistance becomes low. However, in the p-type there is a problem in that the effective work function becomes relatively large because electrons are minority carriers and also electrons must be emitted from the valence band. On the other hand, the effective work function can be kept relatively low in the n-type diamond. To make the n-type diamond, for example, phosphorus is used as a dopant. However, there is a problem in that the doping effect of phosphorus is very low unless it is on the (111) surface of diamond, and as a whole the concentration of impurity becomes so low that the resistance will be high. For example, as described in Japanese Laid Open Patent Publication No. Hei 8-264111, even if phosphorous doped diamond is grown by the gas phase synthesis method in a concave formed on Si, the amount of phosphorous dope is so low that only a high-resistance diamond is obtained. An electron emission device made by using such a high-resistance diamond requires high driving voltage causing loss of electric power, shortening of life span due to heat generation and the like.

The object of the present invention is to solve these problems and to provide a diamond electron emission device with high conductivity, even though it is n-type, and with sharpened edges, and a method for producing the same.

The method for producing a diamond electron emission device of the present invention consists of a step for forming concave molds on a surface of a substrate and a step for growing diamond heteroepitaxially on the substrate in an atmosphere containing a doping material. It is preferable that the crystal structure on a slope in the concave molds on the substrate has a cubic crystal system crystal orientation (111) and the doping material is phosphorus.

It is preferable that the substrate is Si, and the slope in the molds is Si (111) face. The slope in the molds may be Ir (111) face or Pt (111) face. In the step at which the diamond is grown heteroepitaxially, the atmospheric gas preferably contains phosphine.

Further, the diamond electron emission device of the present invention contains projections on the surface, as shown in FIG. 1, wherein the slope of the projection 1 is the face containing diamond (111) and a flat part 2, which does not contain projections, includes face orientations other than (100) face or (110) face and grain boundaries.

Still further, it is preferable that inside of the projection includes at least a layer of phosphorous doped diamond, which is layered in the orientation of face (111), and a non-doped diamond layer or p-type doped diamond layer may be disposed outside of the phosphorous doped diamond layer.

Furthermore, an insulator and a gate electrode formed thereon may be disposed on the diamond. The regulation of electron emission becomes easier by providing the gate electrode.

The above, and other objects, features and advantages of the present invention will become apparent from the following description read in conjunction with the accompanying drawings, in which like reference numerals designate the same elements.

BEST MODE FOR CARRYING OUT THE INVENTION

Figure 2A:
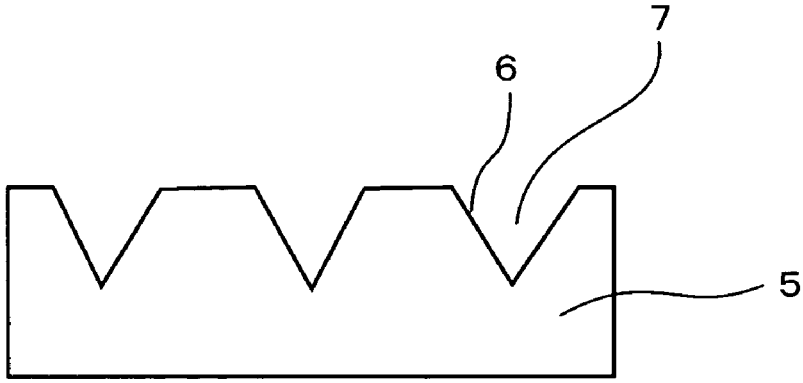
FIGS. 2A and 2B are cross section drawings indicating a method for producing a diamond electron emission device of the present invention.
Figure 2B:
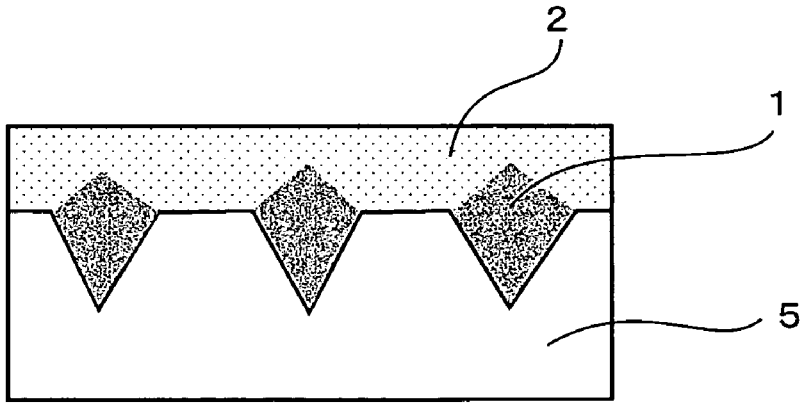

An embodiment of the present invention is explained in detail in the case of Si substrate. As shown in FIG. 2, a heat oxidized film layer (not shown) with about 100-500 nm thickness is formed on one of the surface of Si (100) substrate 5. Resist is applied thereon, the patterning is performed by exposing to light, and square openings are formed on the heat oxidized film layer with buffered hydrofluoric acid. Next, reverse pyramid shaped concavities 7, which are surrounded by (111) faces 6, are formed on the Si substrate by performing anisotropic etching on the Si substrate by potassium hydroxide solution.

Next, the diamond is grown by the microwave plasma CVD method. After washing the Si substrate on which the concave sections are formed, the Si substrate is placed in a microwave CVD apparatus, and the diamond is grown heteroepitaxially, wherein microwave plasma is generated by applying a −100--300 V, direct current bias to the substrate in an atmosphere of hydrogen containing methane and phosphine.

The preferred temperature of the Si substrate while the diamond is growing is 700-1000 deg. centigrade and the preferred atmospheric pressure is 1.3-2.6 kPa. The preferred flow rate (concentration) ratio of methane to hydrogen is about 0.001-2%. The preferred phosphine concentration is about a few times 10,000 ppm but not specially limited to that.

Thus, since the concave parts of the Si substrate are surrounded by the crystal orientation (111) face, the diamond grows heteroepitaxially as a (111) face. Since the atmospheric gas contains phosphine, the diamond growing as the (111) face is doped with phosphorous with high efficiency. Therefore, a diamond part 1 grown as the (111) face has high conductivity.

Further, the diamond also grows on a flat part of the Si substrate, which is not in the concave part. However, because the flat part is not a (111) face, the diamond tends not to grow heteroepitaxially and forms with orientations other than (100) or (110) and polycrystals with grain boundaries. Since this diamond 2 is not formed with the (111) face, the doping effect of phosphorous is low and the conductivity is low.

Then by removing the Si substrate, the diamond electron emission device consisting of the projection part 1, which is surrounded by the (111) face, and the flat part 2, which includes the faces other than the (100) face or the (110) face and the grain boundaries may be obtained.

The best embodiment of the present invention is described as above in the case of the Si substrate. However, the substrate material is not necessarily limited to Si, if diamond can grow heteroepitaxially on the material used in the substrate. For example, a thin film of Ir may be formed on a substrate with concave parts of reverse pyramid shape to form a Ir (111) face in the concave parts. Since the lattice constant of Ir is much closer to that of diamond, diamond with a good crystallinity may be grown on the Ir (111) face. Similarly a Pt (111) face may be formed.

Further, as a doping material to obtain an n-type diamond, a gas containing phosphorous is preferred. Phosphine is the best among phosphorous-containing gases. Since practically only the (111) face of the diamond is doped with phosphorous, only the diamond (111) grown in the concaves of the substrate is doped with phosphorus and thus becomes the n-type diamond with a high conductivity. The diamond on the flat part is not doped in practice and may become an insulating diamond.

Still further, a non-doped diamond (i-type) layer 3 or a p-type diamond layer may be formed on the projection part 1 which is doped with phosphorous. Since electrons can be efficiently injected from the n-type diamond to the i-type or p-type diamond surface with a negative electron-affinity by forming a laminated structure of n-type/i-type or n-type/p-type, a superior characteristic for electron emission may be obtained.

The First Embodiment

A heat oxidized film layer with 300 nm thickness is formed on a surface of a Si (100) substrate. After patterning by applying resist thereon and by exposing to light, square openings are formed on the heat oxidized film layer with buffered hydrofluoric acid. The length of a side of the square is 20 microns. The squares are formed in a 2 mm×2 mm area, separated by 20 microns. Next, reverse pyramid shaped concaves, which are surrounded by the Si (111) face, are formed by subjecting Si (100) to anisotropic etching with potassium hydroxide solution.

After the resist is removed by washing the Si substrate, and the heat oxidized film layer is removed by hydrofluoric acid and the like, the Si substrate is placed in a microwave plasma CVD apparatus, and the diamond is grown. The conditions for the membrane growth is as follows: the ratio of the flow rate of methane to hydrogen is 0.05%, the ratio of the flow rate of phosphine to methane is 0.1%, the direct current bias applied to the substrate is −200 volt, the temperature of the substrate is 900 deg. centigrade and the pressure of the atmosphere is 13.3 kPa.

Figure 1:
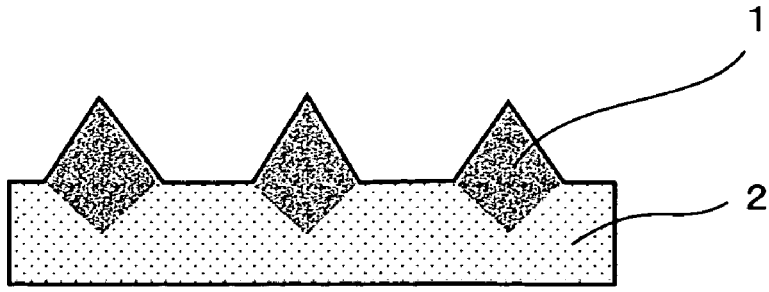
FIG. 1 is a cross section drawing of a diamond electron emission device of the present invention.

Growing the diamond in the condition described above, the diamond (111) 1 grows heteroepitaxially in the reverse pyramid shaped concaves which are surrounded by Si (111), and the diamond 2, which includes the face orientations other than the (100) face or the (110) face and grain boundaries, grows on the flat part of the Si (100) substrate. A diamond electron emission device with projections as shown in FIG. 1 is obtained by removing the Si substrate with nitric-hydrofluoric acid. The diamond (111) in the projection part is conductive but there is no conductivity between the projection parts.

A cathode wiring is disposed on the diamond 10 with the pyramid shaped projections 1, which is produced as described above, and placed in a vacuum chamber facing an anode 15 to which an anode wiring 16 is disposed. When voltage is applied between the anode and cathode with an electric power source, which is not shown in the figure, a highly efficient emission of electrons is confirmed.

The Second Embodiment

An Si (100) substrate with reverse pyramid concavities is prepared as in the first embodiment. While heating this substrate at 700 deg. centigrade, a thin film of Ir is formed thereon by the RF sputter method to a thickness of 0.5 microns, and then ion-irradiation is performed with direct-current discharge. The condition of the ion irradiation is as follows: in hydrogen atmosphere containing 2% of methane, at atmospheric pressure of 13.3 kPa, at the current density of 200 mA/cm$^2$ and irradiation time of 30 seconds.

Then the diamond is grown as in the first embodiment. As a result, the diamond (111) grows heteroepiaxially in the reverse pyramid shaped concaves, which is surrounded by Ir (111). Diamond with face orientations other than the (100) face or the (110) face and grain boundaries grows in the flat part of the Si (100) substrate. A diamond electron emission device with projections as shown in FIG. 1 is obtained by removing the Si substrate with nitric-hydrofluoric acid. The diamond (111) in the projection part is conductive but there is no conductivity between the projection parts.

Figure 4A:
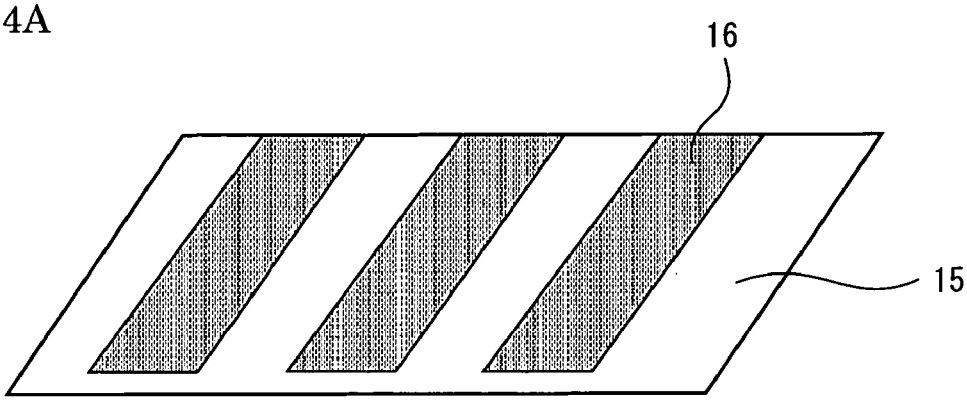
FIGS. 4A and 4B are perspective views showing an example of assembled diamond electron emission device of the present invention.
Figure 4B:
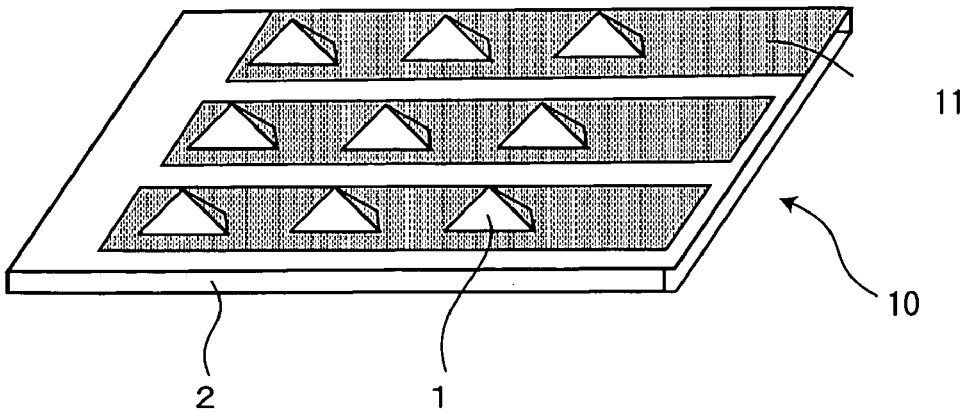
Figure 5:
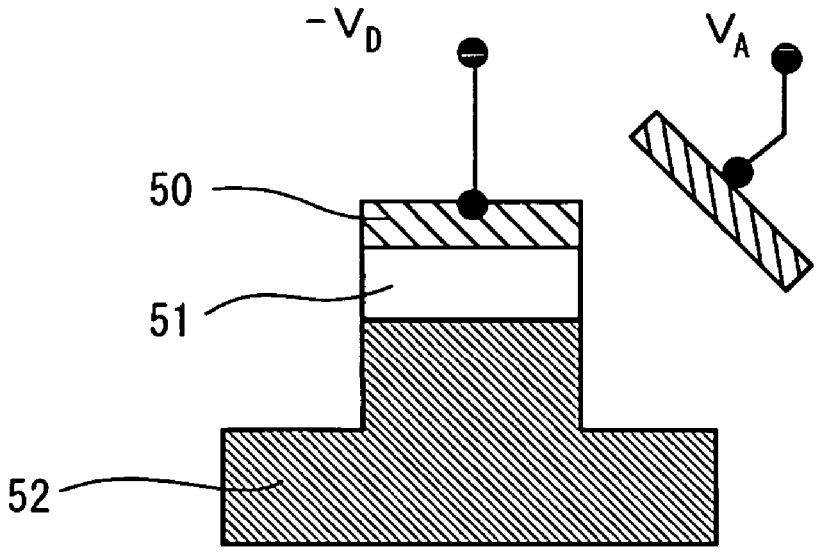
FIG. 5 is a cross section drawing of a conventional diamond electron emission device.
Figure 6A:
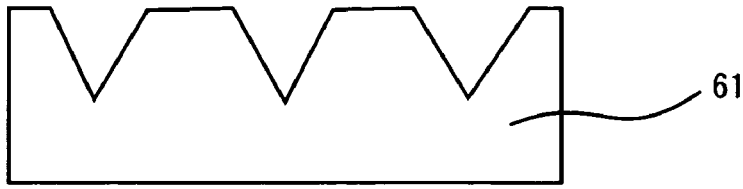
FIGS. 6A-6C are cross section drawings indicating a method for producing a conventional diamond electron emission device.
Figure 6B:
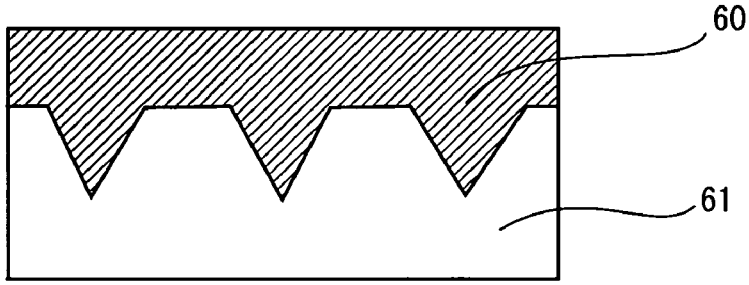
Figure 6C:
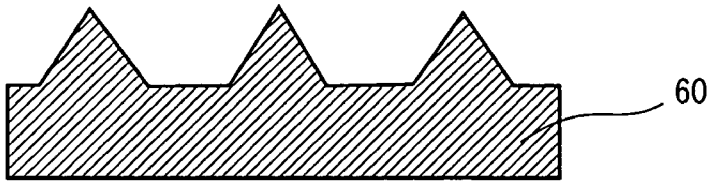

As shown schematically in FIG. 4, a cathode wiring 11 is disposed on the diamond 10 with the pyramid shaped projections 1, which is produced as described above, and placed in a vacuum chamber facing an anode 15. When voltage is applied between the anode and cathode with an electric power source, which is not shown in the figure, a highly efficient emission of electrons is confirmed.

The Third Embodiment

Figure 3:
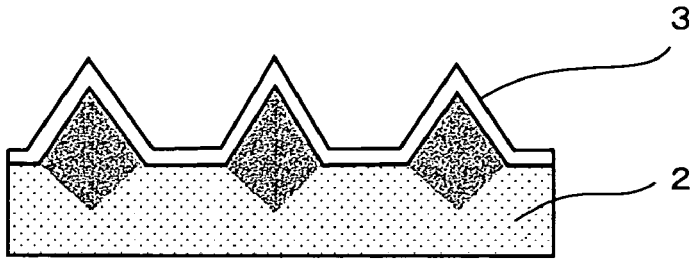
FIG. 3 is a cross section drawing of the other diamond electron emission device of the present invention.

A diamond electron emission device is obtained as in the first embodiment. A non-doped diamond layer 3 (i-type diamond) is formed on this diamond electron emission device as shown in FIG. 3 by the microwave plasma CVD method. The condition of the formation is as follows: the temperature of the diamond electron emission device is 850 deg. centigrade, concentration ratio of methane against hydrogen is 0.05% and atmospheric pressure is 13.3 kPa.

As in the first embodiment, the device is placed in a vacuum chamber and the characteristic for electron emission is investigated. The emission of electrons is confirmed at a lower voltage than in the first embodiment.

By forming a laminated structure of n-type/i-type, electrons can be efficiently injected from the n-type diamond to the i-type diamond surface which has a negative electron-affinity. Therefore it is understood that a superior characteristic for electron emission may be obtained with low driving voltage.

The Fourth Embodiment

Figure 7:
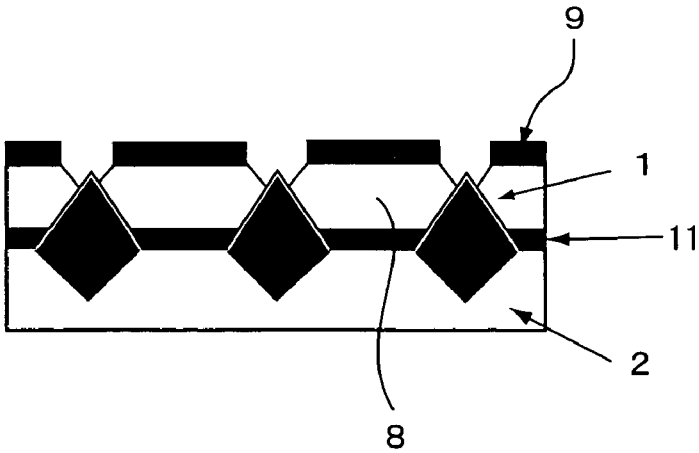
FIG. 7 is a cross section drawing of the other diamond electron emission device of the present invention.

A diamond with phosphorus doped pyramid shaped projections 1 is formed as in the second embodiment, and a cathode wiring 11 is disposed as shown in FIG. 7. $SiO_2$ is formed on the cathode wiring 11 by sputtering as an insulating layer 8, and Mo is formed thereon by sputtering as a gate electrode 9. Then, Mo of the tip parts of the pyramid like projections of diamond is removed by etching with nitric acid and sulfuric acid and the insulating layer around the pyramid like projection of diamond is removed by buffered hydrofluoric acid and the diamond electrodes are formed as shown in FIG. 7. This device is placed in a vacuum chamber as in the second embodiment in the opposite place of the anode, and when voltage is applied between the anode and cathode, the emission of electrons is confirmed at a lower voltage than in the second embodiment.

INDUSTRIAL APPLICABILITY

By the method for producing an electron emission device of the present invention, a diamond electron emission device which is a n-type with high conductivity and shaped like projections may be obtained, wherein the diamond is grown heteroepitaxially on a substrate with concave molds, resulting in the improvement of doping efficiency. Such a diamond electron emission device contains projections on the surface wherein the slope of the projection includes the diamond face (110) and the flat part, which does not include projections, contains the face orientations other than (100) or (110) and grain boundaries Such a diamond electron emission device has a superior electron emission characteristic so that high electron releasing current output may be obtained by applying relatively low driving voltage. High efficiency electron beam application instruments such as an electron beam drawing apparatus, a microwave oscillator and the like may be provided using the diamond electron emission device.

The invention claimed is:

1. A diamond electron emission device with projection parts on a surface, wherein:

a slope of said projection parts contains a diamond (111) face, each of said projection parts is conductive, paths between projection parts are nonconductive, and flat parts, which are not said projection parts, contain face orientations other than (100) face or (110) face and grain boundaries.

2. A diamond electron emission device according to claim 1, wherein at least a phosphorous doped diamond layer is included in said projection part and said phosphorous doped diamond layer is layered in (111) face orientation.

3. A diamond electron emission device according to claim 2, wherein a non-doped diamond layer or a p-type doped diamond layer is disposed outside of said phosphorous doped diamond layer in said projection part.

4. A diamond electron emission device according to claim 1, wherein said diamond electron emission device comprises: a diamond with projection parts on its surface; an insulating layer disposed on said diamond; and a gate electrode formed on said insulating layer.

* * * * *